US008931498B2

(12) United States Patent
Nelson

(10) Patent No.: US 8,931,498 B2
(45) Date of Patent: Jan. 13, 2015

(54) PORTABLE ENCLOSURE WITH ELASTICALLY SEALED OPENING

(71) Applicant: Charles R. Nelson, La Pointe, WI (US)

(72) Inventor: Charles R. Nelson, La Pointe, WI (US)

( * ) Notice: Subject to any disclaimer, the term of this patent is extended or adjusted under 35 U.S.C. 154(b) by 0 days.

(21) Appl. No.: 13/718,925

(22) Filed: Dec. 18, 2012

(65) Prior Publication Data

US 2013/0152987 A1 Jun. 20, 2013

Related U.S. Application Data

(60) Provisional application No. 61/630,851, filed on Dec. 19, 2011.

(51) Int. Cl.
*E04H 15/58* (2006.01)
*E04H 15/36* (2006.01)
*E04H 15/02* (2006.01)

(52) U.S. Cl.
CPC ..... *E04H 15/36* (2013.01); *E04H 15/02* (2013.01)
USPC ..... 135/117

(58) Field of Classification Search
CPC ..... E04H 2015/32; E04H 2015/326; E04H 15/58; E04H 15/32
USPC ..... 135/117, 119, 907, 96; 160/179, 87, 160/180, DIG. 8, 329, 378
See application file for complete search history.

(56) References Cited

U.S. PATENT DOCUMENTS

| | | | | | |
|---|---|---|---|---|---|
| 856,221 | A | * | 6/1907 | Bufe | 160/184 |
| 3,136,356 | A | | 6/1964 | Mears | |
| 3,692,082 | A | | 9/1972 | Cromwell | |
| 3,782,399 | A | | 1/1974 | Milner | |
| 3,827,019 | A | * | 7/1974 | Serbu | 335/285 |
| 4,198,997 | A | | 4/1980 | Miller | |
| 4,823,824 | A | | 4/1989 | Smith | |
| 5,575,239 | A | | 11/1996 | Bradburn et al. | |
| 5,634,434 | A | * | 6/1997 | Gibbons et al. | 119/501 |
| 6,014,982 | A | * | 1/2000 | Strevey | 135/124 |
| 6,745,788 | B1 | | 6/2004 | Brown | |
| 2006/0060235 | A1 | * | 3/2006 | Ball | 135/136 |
| 2008/0022942 | A1 | | 1/2008 | Chu | |

FOREIGN PATENT DOCUMENTS

| | | |
|---|---|---|
| JP | 2000-245280 | 9/2000 |
| JP | 2011-115144 | 6/2011 |

* cited by examiner

*Primary Examiner* — Noah Chandler Hawk
(74) *Attorney, Agent, or Firm* — Richard C. Litman

(57) ABSTRACT

The portable enclosure with an elastically sealed opening includes a base and a frame mounted thereon. The frame is formed from a pair of tensioned frame rods having central portions crossing one another. A fabric covering is secured to the frame to define a hollow enclosure. At least one substantially vertically extending opening is formed through the fabric covering. A lower end of the opening is positioned adjacent the base. Fabric sleeves are secured on opposite sides of the opening. An elastic loop extends through the sleeves around the opening. A tensioned rod is mounted on an upper end of the frame, one end thereof being positioned adjacent an upper end of the opening and supporting an upper end of the elastic loop. This support of the elastic loop creates elastic tension therein, which elastically seals the opening.

17 Claims, 7 Drawing Sheets

PORTABLE ENCLOSURE WITH ELASTICALLY SEALED OPENING

CROSS-REFERENCE TO RELATED APPLICATION

This application claims the benefit of U.S. Provisional Patent Application Ser. No. 61/630,851, filed Dec. 19, 2011.

BACKGROUND OF THE INVENTION

1. Field of the Invention

The present invention relates to portable enclosures, such as tents, portable screens, portable shades and the like, and particularly to a portable enclosure with an elastically sealed opening.

2. Description of the Related Art

Portable shading enclosures are often used for recreation, such as family outings, camping trips and the like. Often, families wish to bring their pets with them on such outings. However, since such enclosures typically have seals with mechanical enclosures, such as zippers, hook and loop fasteners, buttons and the like, the enclosure must remain open for the pet to freely travel in and out therefrom. Leaving the enclosure open, however, allows flies and other insects to easily enter the enclosure. Similar problems exist with respect to young children. It would be desirable to provide such an enclosure with a seal that could be easily released by a pet or young child, while minimizing the time the enclosure remains unsealed. Such a structure would be further useful for situations in which the user has his or her hands full or cannot easily open a zipper, latch or the like, such as when the user is wearing gloves, for example.

Thus, a portable enclosure with an elastically sealed opening solving the aforementioned problems is desired.

SUMMARY OF THE INVENTION

The portable enclosure with an elastically sealed opening is configured similar to a conventional tent, portable shade, portable screen or the like, and provides a seal that may be easily penetrated by a pet or young child, while minimizing the time the enclosure remains unsealed. Similar to a conventional tent or the like, the portable enclosure includes a base and a frame mounted thereon. The base may be removable from the frame. Preferably, the frame is formed from a pair of tensioned frame rods having central portions crossing one another. A fabric covering is secured to the frame to define a hollow enclosure.

At least one substantially vertically extending opening is formed through the fabric covering. A lower end of the opening is positioned adjacent the base. A pair of fabric sleeves are respectively secured to opposed edges of the opening, and an elastic loop extends through the fabric sleeves and about the opening.

A tensioned rod is mounted on an upper end of the frame and has one end positioned adjacent an upper end of the opening and supporting an upper end of the elastic loop. This support of the elastic loop creates elastic tension therein, which seals the opening.

These and other features of the present invention will become readily apparent upon further review of the following specification and drawings.

BRIEF DESCRIPTION OF THE DRAWINGS

Similar reference characters denote corresponding features consistently throughout the attached drawings.

DETAILED DESCRIPTION OF THE PREFERRED EMBODIMENTS

Figure 1:
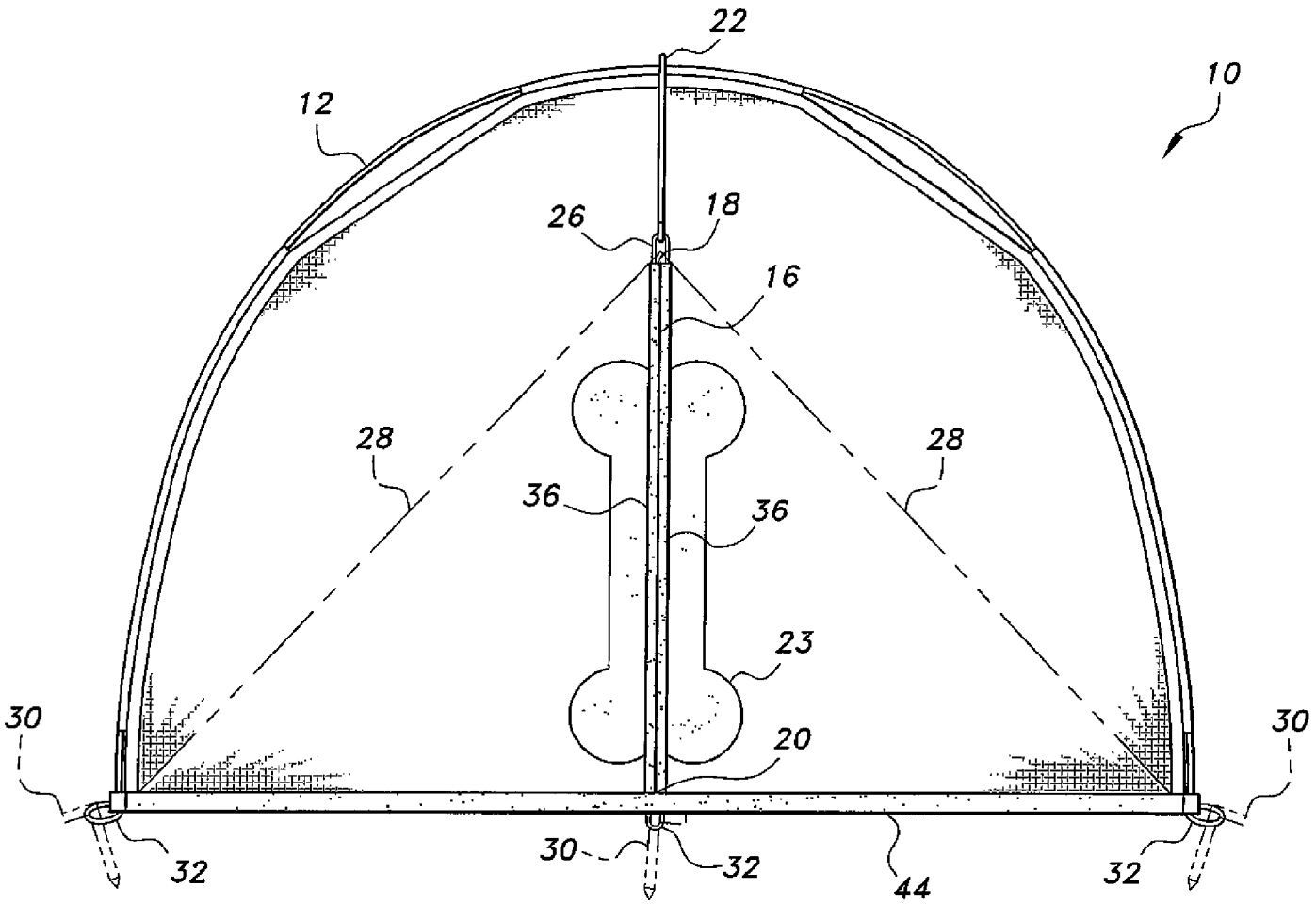
FIG. 1 is a front view of a portable enclosure with an elastically sealed opening according to the present invention.
Figure 2:
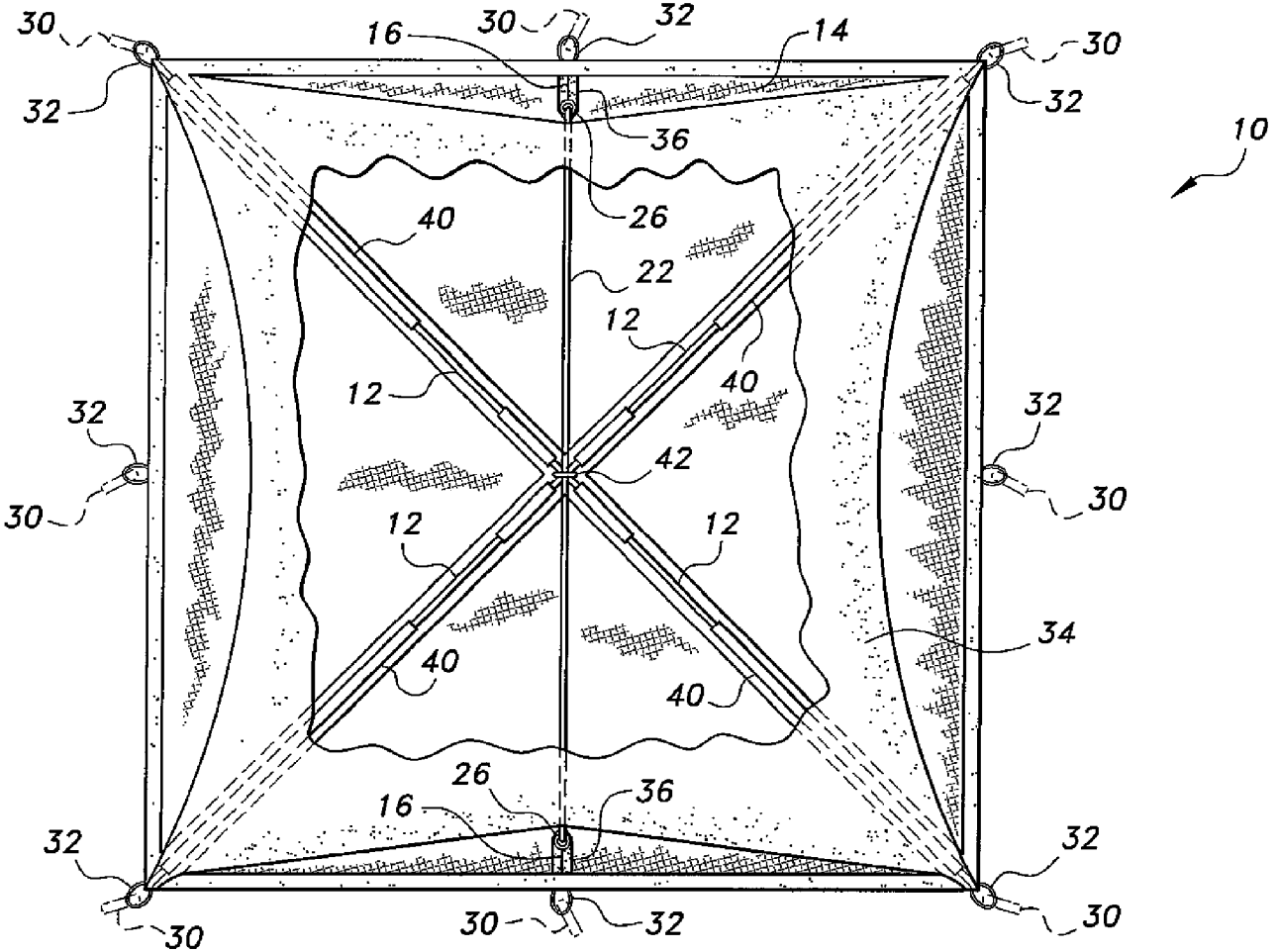
FIG. 2 is a top view of the portable enclosure of FIG. 1, shown with the cover broken away to show details of the frame.

FIG. 1 show a first embodiment of a portable enclosure 10 with an elastically sealed opening 16. The portable enclosure 10 is configured similar to a conventional tent, portable shade, portable screen, or the like, including tensioned frame rods 12 providing an overall frame for supporting a fabric covering 14. As best seen in FIG. 2, a pair of tensioned frame rods 12 are configured diagonally so that each end of the rods 12 define a corner of the enclosure 10. The pair of frame rods 12 preferably cross at their respective central portions. The intersection of the rods 12 is secured by a loop or tie 42 secured to the fabric covering 14. The frame rods 12 are further secured to the fabric covering 14 by sleeves 40. The ends of the rods 12 extending through the sleeves 40, and the sleeves 40 are secured to the covering 14, extending inwardly from the corners of the enclosure 10. The frame rods 12 may be formed from fiberglass or the like, as is conventionally known in the field of portable tents and enclosures.

Although shown in FIGS. 1 and 2 as being formed from net or mesh to form a portable screened enclosure, it should be understood that the covering 14 may be formed from any suitable type of fabric, depending upon the desired application or environment for use of the enclosure 10. Additionally, as shown in FIG. 2, a waterproof covering 34 may cover the upper end of the enclosure 10. The tensioned frame rods 12 and the covering 14 are mounted on a removable base 44. Although the base 44 is shown as being substantially square, it should be understood that the overall configuration and relative dimensions thereof may be varied. Similarly, it should be understood that the overall configuration and relative dimensions of the enclosure 10 defined by the frame rods 12 and the covering 14 may be varied. As shown in FIGS. 1 and 2, a plurality of stake loops 32 extend from the enclosure 10 at each corner and central to each side of base 44 for receiving a corresponding tent stake 30, as is conventionally known. It should be understood that the number and positioning of the stake loops 32 may be varied.

In addition to the tensioned frame rods 12, another tensioned rod 22, which may also be centrally held in place by the loop or tie 42, extends from front to back across the top of the enclosure 10. The tensioned frame rod 22 is used to provide elastic tension for sealing the openings 16, which are formed through the front and rear of the fabric covering 14 of enclosure 10. As shown in FIG. 2, the openings 16 are preferably centrally aligned 180° opposite one another.

Figure 3:
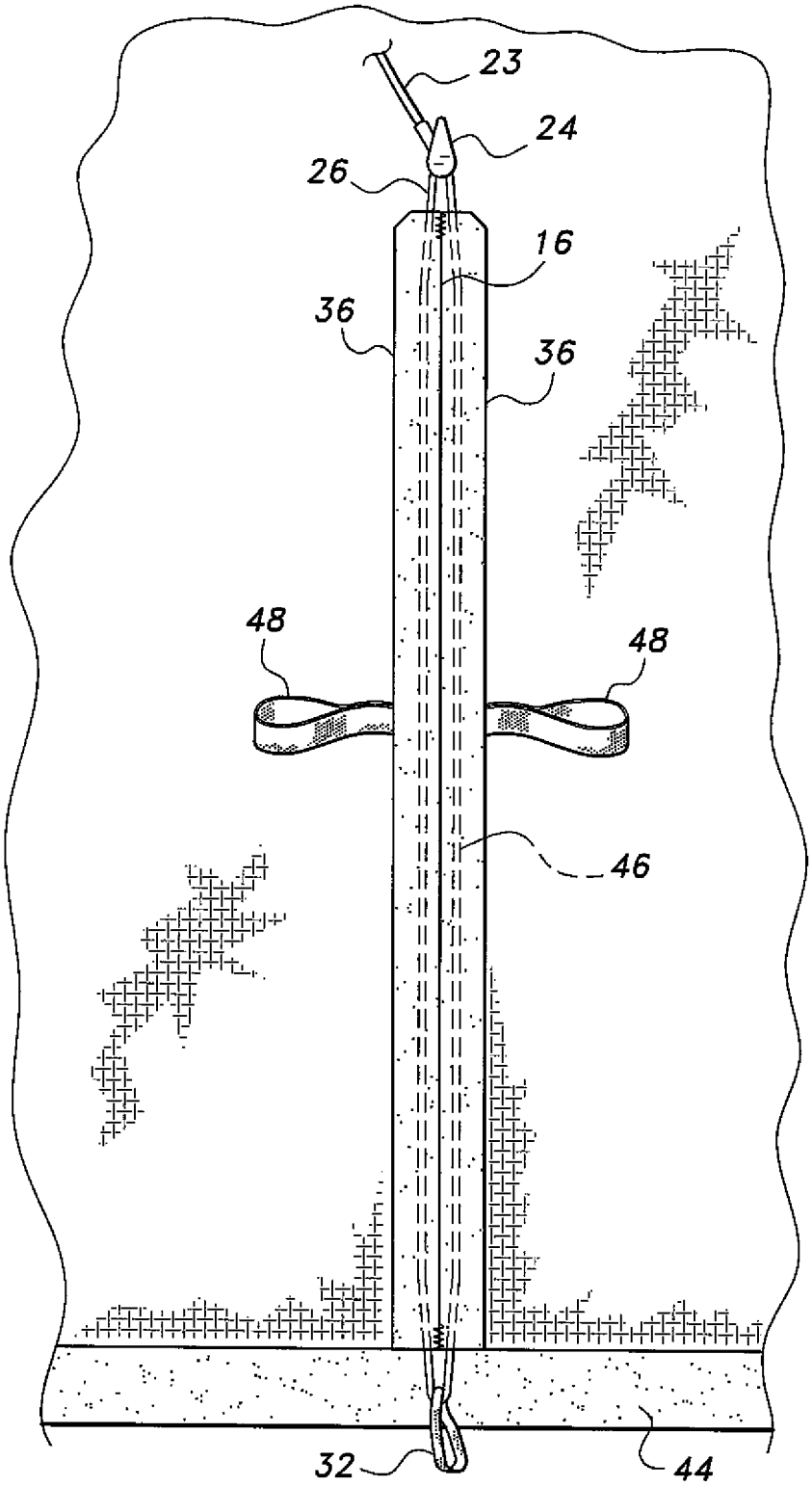
FIG. 3 is a partial front view of the portable enclosure of FIG. 1, particularly illustrating the elastically sealed opening in a closed position.

As best shown in FIG. 3, each end 24 of the front-to-back tensioned rod 22 terminates in a hook 24. The hook 24 holds and supports an upper end 26 of an elastic loop 46. The lower end of the elastic loop 46 is rigidly secured by a stake loop 32 fixed to the ground by a tent stake 30, as shown in FIG. 1. The slit or opening 16 formed through the fabric covering 14 preferably extends vertically, and fabric sleeves 36 are secured to the opposed edges of the opening 16. The elastic loop 46 extends through the sleeves 36. Elastic tension within the cord 46 maintains the opening 16 in the sealed or closed state illustrated in FIG. 3. A pair of handle straps 48 may be secured to the fabric sleeves 36, allowing the user to manually open the opening 16 by grasping and pulling on the handle straps 48. Further, as shown in FIG. 1, indicia 23 or any other desired ornamentation may further be added to the fabric covering 14. It should be understood that FIG. 3 shows the front opening 16, but the rear opening 16 is identically configured and operates in the same fashion.

The arcuate, tensioned frame rods 12 define a substantially dome-like overall configuration for the enclosure 10. However, due to the tension of the front-to-back tensioned rod 22 and the elastic loop 46, the region about the opening 16 is held substantially vertically (indicated as the region under the triangular crease line 28 in FIG. 3), thus maintaining a vertical orientation for the opening 16. It should be understood, however, that the configuration of the frame rods 12 and, thus, the overall configuration of the enclosure 10, may be varied. Further, although the fabric sleeves 36, enclosing each side of the elastic loop 46, are shown in FIG. 3 as being positioned adjacent one another, it should be understood that the sleeves may, alternatively, overlap one another.

Figure 4:
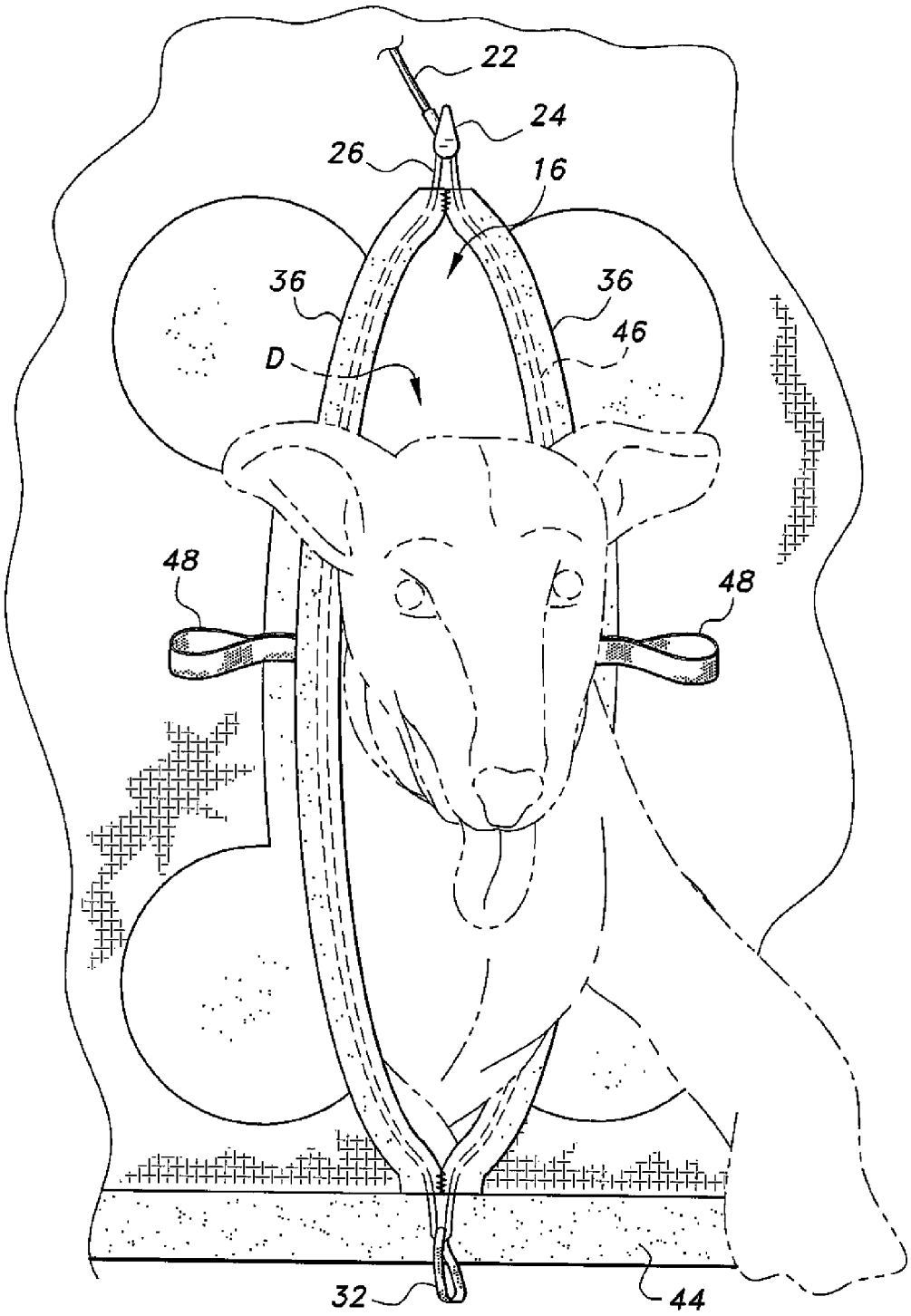
FIG. 4 is a partial environmental front view of the portable enclosure of FIG. 1, showing the elastically sealed opening thereof in operation.

FIG. 4 illustrates the operation of the elastically sealed opening 16. As shown, the exemplary dog D may easily enter the enclosure 10 simply by pushing through the opening 16, which is held under elastic tension by the elastic cord 46 and the tensioned rod 22. Because of the elastic tension, the fabric sleeves 36 covering the edges of opening 16 will press tightly against the dog's body as it passes through the opening 16. This minimizes the size of the opening 16 as the dog D passes through, thus also minimizing the chance that flies or other insects will enter with the dog's passing. Further, since the opening 16 is not sealed by a mechanical closure, such as a zipper, buttons or the like, the dog D may easily pass through, the opening unsealing and sealing itself solely under the elastic tension in the cord 46. It should be understood that the dog D is shown for exemplary purposes only, and that the elastically sealed opening 16 may be used with any type of pet, or alternatively, with young children.

Figure 5:
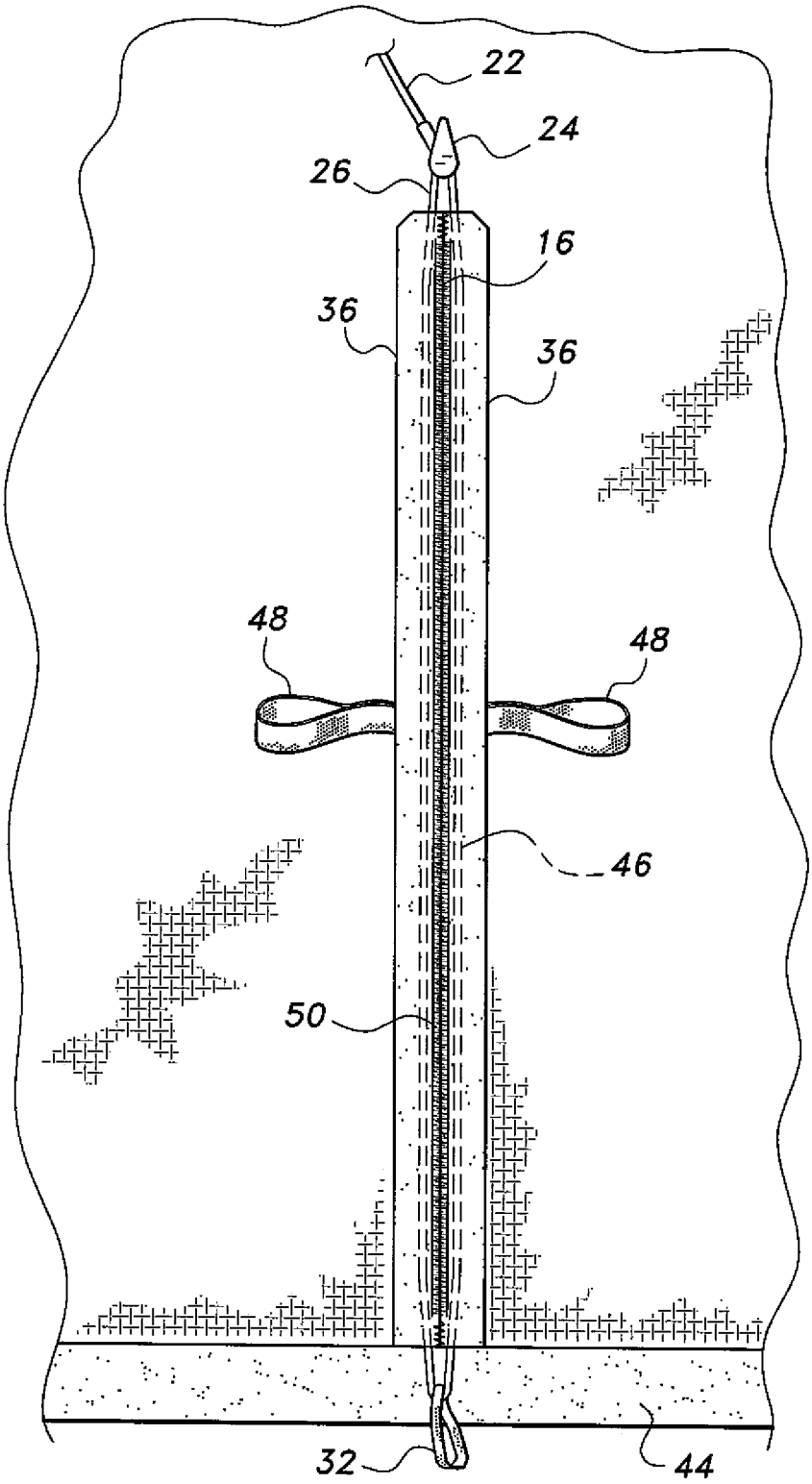
FIG. 5 is a partial front view of an alternative embodiment of a portable enclosure with an elastically sealed opening according to the present invention.
Figure 6:
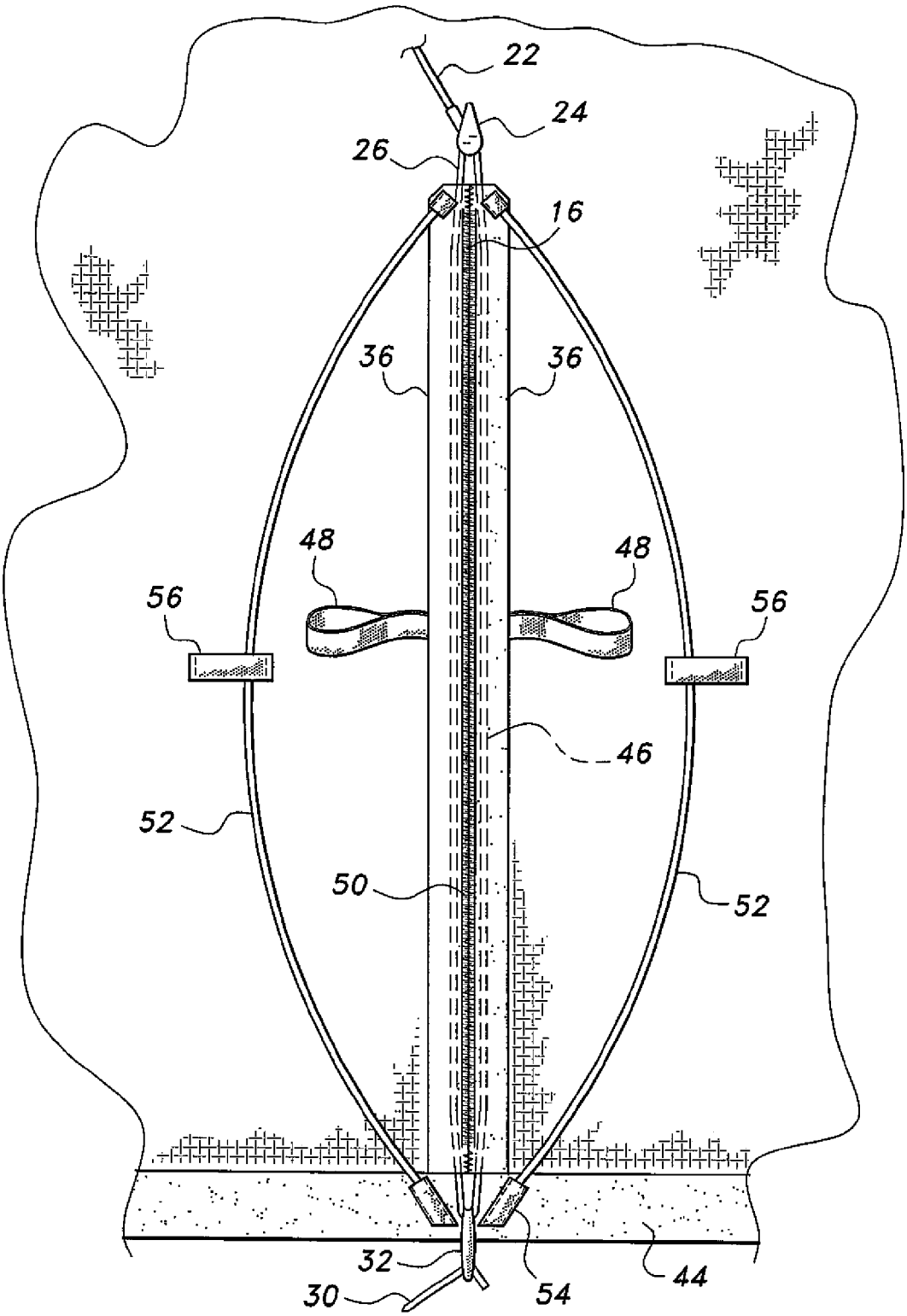
FIG. 6 is a partial front view of another alternative embodiment of a portable enclosure with an elastically sealed opening according to the present invention.

In the alternative embodiment of FIG. 5, brush bristles 50 are secured to each fabric sleeve 36, allowing the tight opening 16 to be further used for brushing and cleaning the dog D as it passes through the opening 16, thus removing dirt, insects and the like it may have picked up while outdoors. As a further alternative, as shown in FIG. 6, additional tensioning may be provided a pair of additional tensioning rods 52 mounted on either side of opening 16. As shown, the rods 52 are secured to the fabric covering 14, and held under tension by sleeves 54, secured to respective upper and lower ends of fabric sleeves 36, and may further be held in place by loops or ties 56 secured to the covering 14.

Figure 7:
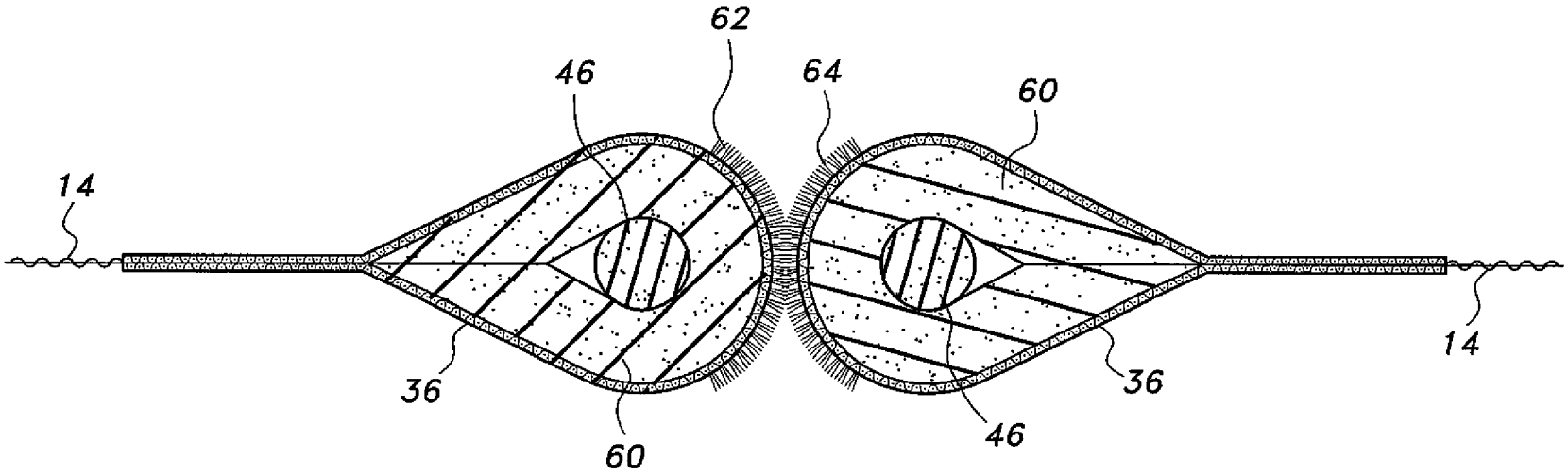
FIG. 7 is a front view in section of a closure for a further alternative embodiment of a portable enclosure with an elastically sealed opening.

Additionally, as shown in the alternative embodiment of FIG. 7, the opening 16 may be further sealed by the addition of hook and loop fasteners 62, 64 secured to the pair of fabric sleeves 36. Further, in the embodiment of FIG. 7, a foam collar or sleeve 60 may be disposed within each fabric sleeve 36, the elastic cord 46 passing through the foam sleeve 60.

It is to be understood that the present invention is not limited to the embodiments described above, but encompasses any and all embodiments within the scope of the following claims.

I claim:

1. A portable enclosure with an elastically sealed opening, comprising:

a base;

a frame mounted on the base;

a fabric covering secured to the frame to define a hollow enclosure, the fabric covering having at least one substantially vertically extending opening defined therein, the opening having an upper end and a lower end positioned adjacent the base;

an elastic loop secured to the fabric covering about the opening;

a tent stake, the elastic loop being secured to the tent stake at the lower end of the opening;

a tensioned rod mounted on the frame, the rod having a first end and a second end, the first end being positioned adjacent the upper end of the opening, the elastic loop being secured to the tensioned rod, whereby the opening is sealed by elastic tension from the elastic loop stretched between the tensioned rod and the tent stake; and fabric sleeves secured to the fabric covering on opposite sides of the opening, said elastic loop extending through the sleeves, wherein a foam collar is disposed within each of the fabric sleeves, said elastic loop extending through the foam collars.

2. The portable enclosure as recited in claim 1, further comprising a handle strap secured to each of the fabric sleeves.

3. The portable enclosure as recited in claim 1, further comprising a set of brush bristles secured to each of said fabric sleeves.

4. The portable enclosure as recited in claim 1, further comprising auxiliary mating releasable fasteners attached to the sleeves for releasably securing the pair of fabric sleeves to one another.

5. The portable enclosure as recited in claim 1, further comprising mating hook and loop fasteners attached to the sleeves for releasably securing the pair of fabric sleeves to one another.

6. The portable enclosure as recited in claim 1, wherein said frame comprises a pair of diagonally configured tensioned frame rods having central portions crossing one another.

7. The portable enclosure as recited in claim 6, further comprising a securing loop secured to an upper end of said fabric covering, the pair of tensioned frame rods crossing at an intersection secured in place by the securing loop.

8. The portable enclosure as recited in claim 1, further comprising a secondary elastic loop secured to said fabric covering about a secondary opening defined therein, the opening having an upper end, the loop being supported by the second end of the tensioned rod at the upper end of the secondary opening, the secondary opening having a lower end, the loop being secured by a second tent stake at the lower end of the opening for elastically sealing the secondary opening.

9. A portable enclosure with an elastically sealed opening, comprising:

a base;

a frame mounted on the base, the frame having a pair of diagonally configured tensioned frame rods having central portions crossing one another;

a fabric covering secured to the frame to define a hollow enclosure, the fabric covering having at least one substantially vertically extending opening defined therein, the opening having an upper end and a lower end positioned adjacent the base;

a pair of fabric sleeves secured to opposite sides of the opening;

an elastic loop extending through the fabric sleeves and around the opening;

a foam collar disposed within each of the fabric sleeves, the elastic loop passing through the foam collars;

a first tent stake, the elastic loop being secured to the tent stake adjacent the lower end of the opening; and a tensioned rod mounted on the frame, the rod having a first end and a second end, the first end being positioned adjacent the upper end of the opening and supporting the elastic loop, whereby the opening is sealed by elastic tension from the elastic loop stretched between the tensioned rod and the first tent stake.

10. The portable enclosure as recited in claim 9, further comprising handle straps secured to the fabric sleeves.

11. The portable enclosure as recited in claim 9, further comprising a set of brush bristles secured to each of the fabric sleeves.

12. The portable enclosure as recited in claim 9, further comprising auxiliary releasable fasteners attached to the fabric sleeves for releasably securing the fabric sleeves to one another.

13. The portable enclosure as recited in claim 9, further comprising a securing loop secured to said fabric covering, the pair of tensioned frame rods crossing at an intersection secured in place by the securing loop.

14. The portable enclosure as recited in claim 9, further comprising a secondary elastic loop secured to said fabric covering about a secondary opening defined therein, the opening having an upper end, the loop being supported by the second end of the tensioned rod at the upper end of the secondary opening, the secondary opening having a lower end, the loop being secured by a second tent stake at the lower end of the opening for elastically sealing the secondary opening.

15. A portable enclosure with an elastically sealed opening, comprising:

a base;

a frame mounted on the base;

a fabric covering secured to the frame to define a hollow enclosure, the fabric covering having at least one substantially vertically extending opening defined therein, the opening having an upper end and a lower end positioned adjacent the base, a pair of auxiliary tensioning rods mounted on the fabric covering on opposite sides of the opening;

an elastic loop secured to the fabric covering about the opening;

a tent stake, the elastic loop being secured to the tent stake at the lower end of the opening;

a tensioned rod mounted on the frame, the rod having a first end and a second end, the first end being positioned adjacent the upper end of the opening, the elastic loop being secured to the tensioned rod, whereby the opening is sealed by elastic tension from the elastic loop stretched between the tensioned rod and the tent stake; and fabric sleeves secured to the fabric covering on opposite sides of the opening, said elastic loop extending through the sleeves.

16. The portable enclosure as recited in claim 15, further comprising upper and lower retaining sleeves secured to upper and lower ends of each of the fabric sleeves for receiving respective upper and lower ends of each of the auxiliary tensioning rods.

17. The portable enclosure as recited in claim 16, further comprising a pair of retaining loops secured to said fabric covering on either side of the opening for retaining respective central portions of the pair of auxiliary tensioning rods.

* * * * *